US008282801B2

(12) United States Patent
Rakiewicz et al.

(10) Patent No.: US 8,282,801 B2
(45) Date of Patent: Oct. 9, 2012

(54) METHODS FOR PASSIVATING A METAL SUBSTRATE AND RELATED COATED METAL SUBSTRATES

(75) Inventors: Edward F. Rakiewicz, Gibsonia, PA (US); Mark W. McMillen, Cabot, PA (US); Richard F. Karabin, Ruffs Dale, PA (US); Michelle Miles, Mercer, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 530 days.

(21) Appl. No.: 12/396,051

(22) Filed: Mar. 2, 2009

(65) Prior Publication Data

US 2010/0159258 A1 Jun. 24, 2010

Related U.S. Application Data

(60) Provisional application No. 61/138,693, filed on Dec. 18, 2008.

(51) Int. Cl.
*C25D 13/00* (2006.01)

(52) U.S. Cl. ..... 204/471; 204/485; 204/486

(58) Field of Classification Search ..... 204/471, 204/486–487; 428/457
See application file for complete search history.

(56) References Cited

U.S. PATENT DOCUMENTS

| | | | | |
|---|---|---|---|---|
| 2,049,517 | A | 8/1936 | Saukaitis | |
| 2,097,211 | A | 10/1937 | Davies | |
| 2,650,156 | A | 8/1953 | Shelton-Jones | |
| 3,095,309 | A | 6/1963 | Zeblisky et al. | |
| 3,539,402 | A | 11/1970 | Ries | |
| 3,579,429 | A * | 5/1971 | Manson et al. | 204/486 |
| 3,615,892 | A | 10/1971 | Heinzelman, Jr. et al. | |
| 3,682,713 | A | 8/1972 | Ries et al. | |
| 3,964,936 | A | 6/1976 | Das | |
| 3,969,135 | A | 7/1976 | King et al. | |
| 4,009,115 | A | 2/1977 | Binns | |
| 4,017,334 | A | 4/1977 | Matsushima et al. | |
| 4,148,670 | A | 4/1979 | Kelly | |
| 4,273,592 | A | 6/1981 | Kelly | |
| 4,338,140 | A | 7/1982 | Reghi | |
| 4,370,177 | A | 1/1983 | Frelin et al. | |
| 4,435,223 | A | 3/1984 | Dollman | |
| 4,437,947 | A | 3/1984 | Saito et al. | |
| 5,104,577 | A | 4/1992 | Ikeda et al. | |
| 5,143,562 | A | 9/1992 | Boulos | |
| 5,296,052 | A | 3/1994 | Ikeda et al. | |
| 5,342,456 | A | 8/1994 | Dolan | |
| 5,380,374 | A | 1/1995 | Tomlinson | |
| 5,759,244 | A | 6/1998 | Tomlinson | |
| 5,769,967 | A | 6/1998 | Dolan | |
| 5,897,716 | A | 4/1999 | Reghi et al. | |
| 5,952,049 | A | 9/1999 | Tomlinson | |
| 6,083,309 | A | 7/2000 | Tomlinson | |
| 6,447,662 | B1 * | 9/2002 | Brouwer et al. | 204/486 |
| 6,562,148 | B1 | 5/2003 | Wendel et al. | |
| 6,749,694 | B2 | 6/2004 | Greene et al. | |
| 6,761,933 | B2 | 7/2004 | Warburton et al. | |
| 6,805,756 | B2 | 10/2004 | Claffey et al. | |
| 6,869,513 | B2 * | 3/2005 | Kulfan et al. | 204/488 |
| 2003/0205299 | A1 | 11/2003 | Greene et al. | |
| 2003/0221751 | A1 | 12/2003 | Claffey et al. | |
| 2004/0144451 | A1 | 7/2004 | Matsukawa et al. | |
| 2004/0163735 | A1 | 8/2004 | Matsukawa et al. | |
| 2004/0163736 | A1 | 8/2004 | Matsukawa et al. | |
| 2004/0170840 | A1 | 9/2004 | Matsukawa et al. | |
| 2004/0187967 | A1 | 9/2004 | Matsukawa et al. | |
| 2004/0244874 | A1 | 12/2004 | Nakayama et al. | |
| 2004/0244875 | A1 | 12/2004 | Yasuda et al. | |
| 2005/0067057 | A1 | 3/2005 | Ishikura et al. | |
| 2006/0185769 | A1 | 8/2006 | Nakayama et al. | |
| 2008/0230395 | A1 | 9/2008 | Inbe et al. | |

FOREIGN PATENT DOCUMENTS

| | | |
|---|---|---|
| EP | 0930379 | 7/1999 |
| GB | 1293884 | 10/1972 |
| GB | 2014617 | 8/1979 |
| WO | WO 85/05131 | 11/1985 |
| WO | WO 95/10641 | 4/1995 |
| WO | WO 9527809 | 10/1995 |
| WO | WO 96/19595 | 6/1996 |
| WO | WO 96/21752 | 7/1996 |
| WO | WO 0159180 | 8/2001 |

OTHER PUBLICATIONS

United States Environmental Protection Agency, "R.E.D. Facts" (Reregistration Eligibility Decision (RED) document for Mineral Acids), Dec. 1993 EPA-738-F-93-025.*

* cited by examiner

*Primary Examiner* — Jeffrey T Barton
*Assistant Examiner* — Steven Rosenwald
(74) *Attorney, Agent, or Firm* — Steven W. Hays

(57) ABSTRACT

Disclosed are methods for passivating metal substrates, including ferrous substrates, such as cold rolled steel and electrogalvanized steel. The methods comprise the steps of depositing an electropositive metal onto at least a portion of the substrate, followed immediately by electrophoretically depositing on the substrate a curable, electrodepositable coating composition. The present invention also relates to coated substrates produced by the above methods.

16 Claims, No Drawings

METHODS FOR PASSIVATING A METAL SUBSTRATE AND RELATED COATED METAL SUBSTRATES

FIELD OF THE INVENTION

The present invention relates to methods for coating and passivating a metal substrate, including ferrous substrates, such as cold rolled steel and electrogalvanized steel. The present invention also relates to coated metal substrates.

BACKGROUND INFORMATION

The use of protective coatings on metal substrates for improved corrosion resistance and paint adhesion is common. Conventional techniques for coating such substrates include techniques that involve pretreating the metal substrate with a phosphate conversion coating and chrome-containing rinses. Such techniques often involve multiple time- and space-consuming treatment steps. The use of such phosphate and/or chromate-containing compositions, moreover, imparts environmental and health concerns.

As a result, chromate-free and/or phosphate-free pretreatment compositions have been developed. Such compositions are generally based on chemical mixtures that in some way react with the substrate surface and bind to it to form a protective layer. For example, pretreatment compositions based on a group IIIB or IVB metal compound have recently become more prevalent. In some cases, it has been proposed to include copper in such compositions to improve the corrosion resisting properties of the composition. The corrosion resistance capability of these pretreatment compositions, however, even when copper is included, has generally been significantly inferior to conventional phosphate and/or chromium containing pretreatments. Moreover, the inclusion of copper in such compositions can result in the discoloration of some subsequently applied coatings, such as certain electrodeposited coatings, particularly non-black coatings. In addition, inclusion of copper in the pretreatment composition can make it more difficult to maintain the proper composition of materials in the pretreatment bath, as copper tends to deposit onto the metal surface at a rate different from the other metals in the composition.

As a result, it would be desirable to provide methods for treating a metal substrate that overcome at least some of the previously described drawbacks of the prior art, including the environmental drawbacks associated with the use of chromates and/or phosphates. Moreover, it would be desirable to provide methods for treating metal substrate that, in at least some cases, imparts corrosion resistance properties that are equivalent to, or even superior to, the corrosion resistance properties impart through the use of phosphate conversion coatings. It would also be desirable to provide related coated metal substrates.

SUMMARY OF THE INVENTION

The present invention is directed to methods for passivating a metal substrate surface. The methods comprise the steps of: (a) depositing an electropositive metal onto at least a portion of the substrate, followed immediately by (b) electrophoretically depositing on the substrate a curable, electrodepositable coating composition.

The present invention is also directed to substrates treated thereby.

DETAILED DESCRIPTION OF THE INVENTION

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

As previously mentioned, the present invention is directed to methods for treating (passivating) a metal substrate. Suitable metal substrates for use in the present invention include those that are often used in the assembly of automotive bodies, automotive parts, and other articles, such as small metal parts, including fasteners, i.e., nuts, bolts, screws, pins, nails, clips, buttons, and the like. Specific examples of suitable metal substrates include, but are not limited to, cold rolled steel, hot rolled steel, steel coated with zinc metal, zinc compounds, or zinc alloys, such as electrogalvanized steel, hot-dipped galvanized steel, galvanealed steel, and steel plated with zinc alloy. Also, aluminum alloys, aluminum plated steel and aluminum alloy plated steel substrates may be used. Other suitable non-ferrous metals include copper and magnesium, as well as alloys of these materials. Moreover, the bare metal substrate being coating by the methods of the present invention may be a cut edge of a substrate that is otherwise treated and/or coated over the rest of its surface. The metal substrate coated in accordance with the methods of the present invention may be in the form of, for example, a sheet of metal or a fabricated part.

The substrate to be treated in accordance with the methods of the present invention may first be cleaned to remove grease, dirt, or other extraneous matter. This is often done by employing mild or strong alkaline cleaners, such as are commercially available and conventionally used in metal pretreatment processes. Examples of alkaline cleaners suitable for use in the present invention include Chemkleen 163, Chemkleen 177, and Chemkleen 490MX, each of which is commercially available from PPG Industries, Inc. Such cleaners are often followed and/or preceded by a water rinse.

In step (a) of the present invention, an electropositive metal is deposited on at least a portion of the substrate. As used herein, the term "electropositive metal" refers to metals that are more electropositive than the metal substrate. This means that, for purposes of the present invention, the term "electropositive metal" encompasses metals that are less easily oxidized than the metal of the metal substrate. As will be appreciated by those skilled in the art, the tendency of a metal to be oxidized is called the oxidation potential, is expressed in volts, and is measured relative to a standard hydrogen electrode, which is arbitrarily assigned an oxidation potential of zero. The oxidation potential for several elements is set forth in the table below. An element is less easily oxidized than another element if it has a voltage value, E*, in the following table, that is greater than the element to which it is being compared.

| Element | Half-cell reaction | Voltage, E* |
|---|---|---|
| Potassium | $K^+ + e \rightarrow K$ | −2.93 |
| Calcium | $Ca^{2+} + 2e \rightarrow Ca$ | −2.87 |
| Sodium | $Na^+ + e \rightarrow Na$ | −2.71 |
| Magnesium | $Mg^{2+} + 2e \rightarrow Mg$ | −2.37 |
| Aluminum | $Al^{3+} + 3e \rightarrow Al$ | −1.66 |
| Zinc | $Zn^{2+} + 2e \rightarrow Zn$ | −0.76 |
| Iron | $Fe^{2+} + 2e \rightarrow Fe$ | −0.44 |
| Nickel | $Ni^{2+} + 2e \rightarrow Ni$ | −0.25 |
| Tin | $Sn^{2+} + 2e \rightarrow Sn$ | −0.14 |
| Lead | $Pb^{2+} + 2e \rightarrow Pb$ | −0.13 |
| Hydrogen | $2H^+ + 2e \rightarrow H_2$ | −0.00 |
| Copper | $Cu^{2+} + 2e \rightarrow Cu$ | 0.34 |
| Mercury | $Hg_2^{2+} + 2e \rightarrow 2Hg$ | 0.79 |
| Silver | $Ag^+ + e \rightarrow Ag$ | 0.80 |
| Gold | $Au^{3+} + 3e \rightarrow Au$ | 1.50 |

Thus, when the metal substrate comprises one of the materials listed earlier, such as cold rolled steel, hot rolled steel, steel coated with zinc metal, zinc compounds, or zinc alloys, hot-dipped galvanized steel, galvanealed steel, steel plated with zinc alloy, aluminum alloys, aluminum plated steel, aluminum alloy plated steel, magnesium and magnesium alloys, suitable electropositive metals for deposition thereon in accordance with the present invention include, for example, nickel, copper, silver, and gold, as well mixtures thereof. Copper is used most often.

Any suitable technique may be used to accomplish the deposition of the electropositive metal. In certain embodiments, the deposition is accomplished without the use of electric current. In particular, in certain embodiments, the electropositive metal is deposited by contacting the substrate with a plating solution of a soluble metal salt, such as a soluble copper salt, wherein the metal of the substrate dissolves while the metal in the solution, such as copper, is plated out onto the substrate surface.

The plating solution referenced above is often an aqueous solution of a water soluble metal salt. In certain embodiments of the present invention, the water soluble metal salt is a water soluble copper compound. Specific examples of water soluble copper compounds, which are suitable for use in the present invention include, but are not limited to, copper cyanide, copper potassium cyanide, copper sulfate, copper nitrate, copper pyrophosphate, copper thiocyanate, disodium copper ethylenediaminetetraacetate tetrahydrate, copper bromide, copper oxide, copper hydroxide, copper chloride, copper fluoride, copper gluconate, copper citrate, copper lauroyl sarcosinate, copper formate, copper acetate, copper propionate, copper butyrate, copper lactate, copper oxalate, copper phytate, copper tartarate, copper malate, copper succinate, copper malonate, copper maleate, copper benzoate, copper salicylate, copper aspartate, copper glutamate, copper fumarate, copper glycerophosphate, sodium copper chlorophyllin, copper fluorosilicate, copper fluoroborate and copper iodate, as well as copper salts of carboxylic acids in the homologous series formic acid to decanoic acid, copper salts of polybasic acids in the series oxalic acid to suberic acid, and copper salts of hydroxycarboxylic acids, including glycolic, lactic, tartaric, malic and citric acids.

When copper ions supplied from such a water-soluble copper compound are precipitated as an impurity in the form of copper sulfate, copper oxide, etc., it may be preferable to add a complexing agent that suppresses the precipitation of copper ions, thus stabilizing them as a copper complex in the solution.

In certain embodiments, the copper compound is added as a copper complex salt such as $K_3Cu(CN)_4$ or Cu-EDTA, which can be present stably in the plating solution on its own, but it is also possible to form a copper complex that can be present stably in the plating solution by combining a complexing agent with a compound that is difficultly soluble on its own. Examples thereof include a copper cyanide complex formed by a combination of CuCN and KCN or a combination of CuSCN and KSCN or KCN, and a Cu-EDTA complex formed by a combination of $CuSO_4$ and EDTA.2Na.

With regard to the complexing agent, a compound that can form a complex with copper ions can be used; examples thereof include inorganic compounds, such as cyanide compounds and thiocyanate compounds, and polycarboxylic acids, and specific examples thereof include ethylenediaminetetraacetic acid, salts of ethylenediaminetetraacetic acid, such as dihydrogen disodium ethylenediaminetetraacetate dihydrate, aminocarboxylic acids, such as nitrilotriacetic acid and iminodiacetic acid, oxycarboxylic acids, such as citric acid and tartaric acid, succinic acid, oxalic acid, ethylenediaminetetramethylenephosphonic acid, and glycine.

In certain embodiments, the electropositive metal, such as copper, is included in the plating solution in an amount of at least 1 part per million ("ppm"), such as at least 50 ppm, or, in some cases, at least 100 ppm of total metal (measured as elemental metal). In certain embodiments, the electropositive metal, such as copper, is included in the plating solution in an amount of no more than 5,000 ppm, such as no more than 1,000 ppm, or, in some cases, no more than 500 ppm of total metal (measured as elemental metal). The amount of electropositive metal in the plating solution can range between any combination of the recited values inclusive of the recited values.

In addition to the water soluble metal salt and optional complexing agent, the plating solution utilized in certain embodiments of the present invention may also include other additives. For example, a stabilizer, such as 2-mercaptobenzothiazole, may be used. Other optional materials include surfactants that function as defoamers or substrate wetting agents. Anionic, cationic, amphoteric, or nonionic surfactants may be used. Compatible mixtures of such materials are also suitable. Defoaming surfactants are often present at levels up to 1 percent, such as up to 0.1 percent by volume, and wetting agents are often present at levels up to 2 percent, such as up to 0.5 percent by volume, based on the total volume of the solution.

In certain embodiments, the aqueous plating solution utilized in certain embodiments of the present invention has a pH at application of less than 6, in some cases the pH is within the range of 1 to 4, such as 1.5 to 3.5. In certain embodiments, the pH of the solution is maintained through the inclusion of an acid. The pH of the solution may be adjusted using mineral acids, such as hydrofluoric acid, fluoroboric acid, nitric acid and phosphoric acid, including mixtures thereof; organic acids, such as lactic acid, acetic acid, citric acid, sulfamic acid, or mixtures thereof; and water soluble or water dispersible bases, such as sodium hydroxide, ammonium hydroxide, ammonia, or amines such as triethylamine, methylethyl amine, or mixtures thereof.

The plating solution may be brought into contact with the substrate by any of a variety of techniques, including, for example, dipping or immersion, spraying, intermittent spraying, dipping followed by spraying, spraying followed by dipping, brushing, or roll-coating. In certain embodiments, a dipping or immersion technique is used and the solution, when applied to the metal substrate, is at a temperature ranging from 60 to 185° F. (15 to 85° C.). The contact time is often from 10 seconds to five minutes, such as 30 seconds to 2 minutes. After removal of the substrate from the plating solution, the substrate may, if desired, be rinsed with water such as deionized water and dried.

In certain embodiments, the residue of the plating solution, i.e., the electropositive metal, is present on the substrate in an amount ranging from 1 to 1000 milligrams per square meter ($mg/m^2$), such as 10 to 400 $mg/m^2$. The thickness of the residue of the plating solution can vary, but it is generally very thin, often having a thickness of less than 1 micrometer, in some cases it is from 1 to 500 nanometers, and, in yet other cases, it is 10 to 300 nanometers.

It is noteworthy that in the method of the present invention, the metal substrate is not contacted with any pretreatment composition other than the plating solution. As used herein, the term "pretreatment composition" refers to a composition that, upon contact with the substrate, reacts with and chemically alters the substrate surface and binds to it to form a protective layer. Moreover, the plating solution used in step (a) of the method of the present invention is essentially free of metal phosphates and chromates that are found in conventional pretreatment compositions. By "essentially free" is meant that if the material is present in the composition, it is present incidentally and preferably in less than trace amounts. It is an advantage of the present invention that metal surfaces can be passivated by following the methods of the present invention without the use of conventional pretreatment compositions such as trication phosphate metal solutions and methods using these solutions, which often involve twelve to fifteen process stages, and yet corrosion resistance comparable to that shown by metal substrates treated conventionally can be achieved by the methods of the present invention.

In the method of the present invention, deposition of the electropositive metal onto the surface of the metal substrate in step (a) is immediately followed by (b) electrophoretically depositing on the substrate a curable, electrodepositable coating composition. By "immediately following" is meant that there are no intervening substantive treatment steps such as contact with a conventional pretreatment composition as mentioned above. In step (b) of the method of the present invention, an electrodepositable composition is deposited onto the metal substrate by electrodeposition. In the process of electrodeposition, the metal substrate being treated, serving as an electrode, and an electrically conductive counter electrode are placed in contact with an ionic, electrodepositable composition. Upon passage of an electric current between the electrode and counter electrode while they are in contact with the electrodepositable composition, an adherent film of the electrodepositable composition will deposit in a substantially continuous manner on the metal substrate.

Electrodeposition is usually carried out at a constant voltage in the range of from 1 volt to several thousand volts, typically between 50 and 500 volts. Current density is usually between 1.0 ampere and 15 amperes per square foot (10.8 to 161.5 amperes per square meter) and tends to decrease quickly during the electrodeposition process, indicating formation of a continuous self-insulating film.

The electrodepositable composition utilized in certain embodiments of the present invention often comprises a resinous phase dispersed in an aqueous medium wherein the resinous phase comprises: (a) an active hydrogen group-containing ionic electrodepositable resin, and (b) a curing agent having functional groups reactive with the active hydrogen groups of (a).

In certain embodiments, the electrodepositable compositions utilized in certain embodiments of the present invention contain, as a main film-forming polymer, an active hydrogen-containing ionic, often cationic, electrodepositable resin. A wide variety of electrodepositable film-forming resins are known and can be used in the present invention so long as the polymers are "water dispersible," i.e., adapted to be solubilized, dispersed or emulsified in water. The water dispersible polymer is ionic in nature, that is, the polymer will contain anionic functional groups to impart a negative charge or, as is often preferred, cationic functional groups to impart a positive charge.

Examples of film-forming resins suitable for use in anionic electrodepositable compositions are base-solubilized, carboxylic acid containing polymers, such as the reaction product or adduct of a drying oil or semi-drying fatty acid ester with a dicarboxylic acid or anhydride; and the reaction product of a fatty acid ester, unsaturated acid or anhydride and any additional unsaturated modifying materials which are further reacted with polyol. Also suitable are the at least partially neutralized interpolymers of hydroxy-alkyl esters of unsaturated carboxylic acids, unsaturated carboxylic acid and at least one other ethylenically unsaturated monomer. Still another suitable electrodepositable film-forming resin comprises an alkyd-aminoplast vehicle, i.e., a vehicle containing an alkyd resin and an amine-aldehyde resin. Yet another anionic electrodepositable resin composition comprises mixed esters of a resinous polyol, such as is described in U.S. Pat. No. 3,749,657 at col. 9, lines 1 to 75 and col. 10, lines 1 to 13, the cited portion of which being incorporated herein by reference. Other acid functional polymers can also be used, such as phosphatized polyepoxide or phosphatized acrylic polymers as are known to those skilled in the art.

As aforementioned, it is often desirable that the active hydrogen-containing ionic electrodepositable resin (a) is cationic and capable of deposition on a cathode. Examples of such cationic film-forming resins include amine salt group-containing resins, such as the acid-solubilized reaction products of polyepoxides and primary or secondary amines, such as those described in U.S. Pat. Nos. 3,663,389; 3,984,299; 3,947,338; and 3,947,339. Often, these amine salt group-containing resins are used in combination with a blocked isocyanate curing agent. The isocyanate can be fully blocked, as described in U.S. Pat. No. 3,984,299, or the isocyanate can be partially blocked and reacted with the resin backbone, such as is described in U.S. Pat. No. 3,947,338. Also, one-component compositions as described in U.S. Pat. No. 4,134,866 and DE-OS No. 2,707,405 can be used as the film-forming resin. Besides the epoxy-amine reaction products, film-forming resins can also be selected from cationic acrylic resins, such as those described in U.S. Pat. Nos. 3,455,806 and 3,928,157.

Besides amine salt group-containing resins, quaternary ammonium salt group-containing resins can also be employed, such as those formed from reacting an organic polyepoxide with a tertiary amine salt as described in U.S. Pat. Nos. 3,962,165; 3,975,346; and 4,001,101. Examples of other cationic resins are ternary sulfonium salt group-containing resins and quaternary phosphonium salt-group containing resins, such as those described in U.S. Pat. Nos. 3,793,278 and 3,984,922, respectively. Also, film-forming resins which cure via transesterification, such as described in European Application No. 12463 can be used. Further, cationic compositions prepared from Mannich bases, such as described in U.S. Pat. No. 4,134,932, can be used.

In certain embodiments, the resins present in the electrodepositable composition are positively charged resins which contain primary and/or secondary amine groups, such as described in U.S. Pat. Nos. 3,663,389; 3,947,339; and 4,116,900. In U.S. Pat. No. 3,947,339, a polyketimine derivative of a polyamine, such as diethylenetriamine or triethylenetetraamine, is reacted with a polyepoxide. When the reaction product is neutralized with acid and dispersed in water, free primary amine groups are generated. Also, equivalent products are formed when polyepoxide is reacted with excess polyamines, such as diethylenetriamine and triethylenetetraamine, and the excess polyamine vacuum stripped from the reaction mixture, as described in U.S. Pat. Nos. 3,663,389 and 4,116,900.

In certain embodiments, the active hydrogen-containing ionic electrodepositable resin is present in the electrodepositable composition in an amount of 1 to 60 percent by weight, such as 5 to 25 percent by weight, based on total weight of the electrodeposition bath.

As indicated, the resinous phase of the electrodepositable composition often further comprises a curing agent adapted to react with the active hydrogen groups of the ionic electrodepositable resin. For example, both blocked organic polyisocyanate and aminoplast curing agents are suitable for use in the present invention, although blocked isocyanates are often preferred for cathodic electrodeposition.

Aminoplast resins, which are often the preferred curing agent for anionic electrodeposition, are the condensation products of amines or amides with aldehydes. Examples of suitable amine or amides are melamine, benzoguanamine, urea and similar compounds. Generally, the aldehyde employed is formaldehyde, although products can be made from other aldehydes, such as acetaldehyde and furfural. The condensation products contain methylol groups or similar alkylol groups depending on the particular aldehyde employed. Often, these methylol groups are etherified by reaction with an alcohol, such as a monohydric alcohol containing from 1 to 4 carbon atoms, such as methanol, ethanol, isopropanol, and n-butanol. Aminoplast resins are commercially available from American Cyanamid Co. under the trademark CYMEL and from Monsanto Chemical Co. under the trademark RESIMENE.

The aminoplast curing agents are often utilized in conjunction with the active hydrogen containing anionic electrodepositable resin in amounts ranging from 5 percent to 60 percent by weight, such as from 20 percent to 40 percent by weight, the percentages based on the total weight of the resin solids in the electrodepositable composition.

As indicated, blocked organic polyisocyanates are often used as the curing agent in cathodic electrodeposition compositions. The polyisocyanates can be fully blocked as described in U.S. Pat. No. 3,984,299 at col. 1, lines 1 to 68, col. 2, and col. 3, lines 1 to 15, or partially blocked and reacted with the polymer backbone as described in U.S. Pat. No. 3,947,338 at col. 2, lines 65 to 68, col. 3, and col. 4 lines 1 to 30, the cited portions of which being incorporated herein by reference. By "blocked" is meant that the isocyanate groups have been reacted with a compound so that the resultant blocked isocyanate group is stable to active hydrogens at ambient temperature but reactive with active hydrogens in the film forming polymer at elevated temperatures usually between 90° C. and 200° C.

Suitable polyisocyanates include aromatic and aliphatic polyisocyanates, including cycloaliphatic polyisocyanates and representative examples include diphenylmethane-4,4'-diisocyanate (MDI), 2,4- or 2,6-toluene diisocyanate (TDI), including mixtures thereof, p-phenylene diisocyanate, tetramethylene and hexamethylene diisocyanates, dicyclohexylmethane-4,4'-diisocyanate, isophorone diisocyanate, mixtures of phenylmethane-4,4'-diisocyanate and polymethylene polyphenylisocyanate. Higher polyisocyanates, such as triisocyanates can be used. An example would include triphenylmethane-4,4',4"-triisocyanate. Isocyanate ( )-prepolymers with polyols such as neopentyl glycol and trimethylolpropane and with polymeric polyols such as polycaprolactone diols and triols (NCO/OH equivalent ratio greater than 1) can also be used.

The polyisocyanate curing agents are typically utilized in conjunction with the active hydrogen containing cationic electrodepositable resin in amounts ranging from 5 percent to 60 percent by weight, such as from 20 percent to 50 percent by weight, the percentages based on the total weight of the resin solids of the electrodepositable composition.

The electrodepositable compositions described herein are in the form of an aqueous dispersion. The term "dispersion" is believed to be a two-phase transparent, translucent or opaque resinous system in which the resin is in the dispersed phase and the water is in the continuous phase. The average particle size of the resinous phase is generally less than 1.0 and usually less than 0.5 microns, often less than 0.15 micron.

The concentration of the resinous phase in the aqueous medium is often at least 1 percent by weight, such as from 2 to 60 percent by weight, based on total weight of the aqueous dispersion. When such compositions are in the form of resin concentrates, they generally have a resin solids content of 20 to 60 percent by weight based on weight of the aqueous dispersion.

The electrodepositable compositions described herein are often supplied as two components: (1) a clear resin feed, which includes generally the active hydrogen-containing ionic electrodepositable resin, i.e., the main film-forming polymer, the curing agent, and any additional water-dispersible, non-pigmented components; and (2) a pigment paste, which generally includes one or more pigments, a water-dispersible grind resin which can be the same or different from the main-film forming polymer, and, optionally, additives such as wetting or dispersing aids. Electrodeposition bath components (1) and (2) are dispersed in an aqueous medium which comprises water and, usually, coalescing solvents.

As aforementioned, besides water, the aqueous medium may contain a coalescing solvent. Useful coalescing solvents are often hydrocarbons, alcohols, esters, ethers and ketones. The preferred coalescing solvents are often alcohols, polyols and ketones. Specific coalescing solvents include isopropanol, butanol, 2-ethylhexanol, isophorone, 2-methoxypentanone, ethylene and propylene glycol and the monoethyl monobutyl and monohexyl ethers of ethylene glycol. The amount of coalescing solvent is generally between 0.01 and 25 percent, such as from 0.05 to 5 percent by weight based on total weight of the aqueous medium.

In addition, a colorant and, if desired, various additives such as surfactants, wetting agents or catalyst can be included in the coating composition comprising a film-forming resin.

As used herein, the term "colorant" means any substance that imparts color and/or other opacity and/or other visual effect to the composition. The colorant can be added to the composition in any suitable form, such as discrete particles, dispersions, solutions and/or flakes. A single colorant or a mixture of two or more colorants can be used.

Example colorants include pigments, dyes and tints, such as those used in the paint industry and/or listed in the Dry Color Manufacturers Association (DCMA), as well as special effect compositions. A colorant may include, for example, a finely divided solid powder that is insoluble but wettable under the conditions of use. A colorant can be organic or inorganic and can be agglomerated or non-agglomerated. Colorants can be incorporated by use of a grind vehicle, such as an acrylic grind vehicle, the use of which will be familiar to one skilled in the art.

Example pigments and/or pigment compositions include, but are not limited to, carbazole dioxazine crude pigment, azo, monoazo, disazo, naphthol AS, salt type (lakes), benzimidazolone, condensation, metal complex, isoindolinone, isoindoline and polycyclic phthalocyanine, quinacridone, perylene, perinone, diketopyrrolo pyrrole, thioindigo, anthraquinone, indanthrone, anthrapyrimidine, flavanthrone, pyranthrone, anthanthrone, dioxazine, triarylcarbonium, quinophthalone pigments, diketo pyrrolo pyrrole red ("DPPBO red"), titanium dioxide, carbon black and mixtures thereof. The terms "pigment" and "colored filler" can be used interchangeably.

Example dyes include, but are not limited to, those that are solvent and/or aqueous based such as pthalo green or blue, iron oxide, bismuth vanadate, anthraquinone, perylene, aluminum and quinacridone.

Example tints include, but are not limited to, pigments dispersed in water-based or water miscible carriers such as AQUA-CHEM 896 commercially available from Degussa, Inc., CHARISMA COLORANTS and MAXITONER INDUSTRIAL COLORANTS commercially available from Accurate Dispersions division of Eastman Chemical, Inc.

As noted above, the colorant can be in the form of a dispersion including, but not limited to, a nanoparticle dispersion. Nanoparticle dispersions can include one or more highly dispersed nanoparticle colorants and/or colorant particles that produce a desired visible color and/or opacity and/or visual effect. Nanoparticle dispersions can include colorants such as pigments or dyes having a particle size of less than 150 nm, such as less than 70 nm, or less than 30 nm. Nanoparticles can be produced by milling stock organic or inorganic pigments with grinding media having a particle size of less than 0.5 mm. Example nanoparticle dispersions and methods for making them are identified in U.S. Pat. No. 6,875,800 B2, which is incorporated herein by reference. Nanoparticle dispersions can also be produced by crystallization, precipitation, gas phase condensation, and chemical attrition (i.e., partial dissolution). In order to minimize re-agglomeration of nanoparticles within the coating, a dispersion of resin-coated nanoparticles can be used. As used herein, a "dispersion of resin-coated nanoparticles" refers to a continuous phase in which is dispersed discreet "composite microparticles" that comprise a nanoparticle and a resin coating on the nanoparticle. Example dispersions of resin-coated nanoparticles and methods for making them are identified in United States Patent Application Publication 2005-0287348 A1, filed Jun. 24, 2004, U.S. Provisional Application No. 60/482,167 filed Jun. 24, 2003, and U.S. patent application Ser. No. 11/337,062, filed Jan. 20, 2006, which is also incorporated herein by reference.

Example special effect compositions that may be used include pigments and/or compositions that produce one or more appearance effects such as reflectance, pearlescence, metallic sheen, phosphorescence, fluorescence, photochromism, photosensitivity, thermochromism, goniochromism and/or color-change. Additional special effect compositions can provide other perceptible properties, such as opacity or texture. In certain embodiments, special effect compositions can produce a color shift, such that the color of the coating changes when the coating is viewed at different angles. Example color effect compositions are identified in U.S. Pat. No. 6,894,086, incorporated herein by reference. Additional color effect compositions can include transparent coated mica and/or synthetic mica, coated silica, coated alumina, a transparent liquid crystal pigment, a liquid crystal coating, and/or any composition wherein interference results from a refractive index differential within the material and not because of the refractive index differential between the surface of the material and the air.

In certain embodiments, a photosensitive composition and/or photochromic composition, which reversibly alters its color when exposed to one or more light sources, can be used in the present invention. Photochromic and/or photosensitive compositions can be activated by exposure to radiation of a specified wavelength. When the composition becomes excited, the molecular structure is changed and the altered structure exhibits a new color that is different from the original color of the composition. When the exposure to radiation is removed, the photochromic and/or photosensitive composition can return to a state of rest, in which the original color of the composition returns. In certain embodiments, the photochromic and/or photosensitive composition can be colorless in a non-excited state and exhibit a color in an excited state. Full color-change can appear within milliseconds to several minutes, such as from 20 seconds to 60 seconds. Example photochromic and/or photosensitive compositions include photochromic dyes.

In certain embodiments, the photosensitive composition and/or photochromic composition can be associated with and/or at least partially bound to, such as by covalent bonding, a polymer and/or polymeric materials of a polymerizable component. In contrast to some coatings in which the photosensitive composition may migrate out of the coating and crystallize into the substrate, the photosensitive composition and/or photochromic composition associated with and/or at least partially bound to a polymer and/or polymerizable component in accordance with certain embodiments of the present invention, have minimal migration out of the coating. Example photosensitive compositions and/or photochromic compositions and methods for making them are identified in U.S. application Ser. No. 10/892,919 filed Jul. 16, 2004, incorporated herein by reference.

In general, the colorant can be present in the coating composition in any amount sufficient to impart the desired visual and/or color effect. The colorant may comprise from 1 to 65 weight percent, such as from 3 to 40 weight percent or 5 to 35 weight percent, with weight percent based on the total weight of the compositions.

After deposition, the coating is often heated to cure the deposited composition. The heating or curing operation is often carried out at a temperature in the range of from 250 to 400° F. (121.1 to 204.4° C.), such as from 120 to 190° C., for a period of time sufficient to effect cure of the electrodepositable composition, typically ranging from 10 to 60 minutes. In certain embodiments, the thickness of the resultant film is from 10 to 50 microns.

Illustrating the invention are the following examples that are not to be considered as limiting the invention to their details. All parts and percentages in the examples, as well as throughout the specification, are by weight unless otherwise indicated.

Example 1

Cold rolled steel (CRS) panels were cleaned by spraying with a solution of Chemkleen 490MX, an alkaline cleaner available from PPG Industries, for two minutes at 120° F. After alkaline cleaning, the panels were rinsed thoroughly with deionized water. Some of the panels were then immersed in an acidic solution containing various amounts of copper for two minutes at 120° F. The acid solution was prepared by diluting 198.1 grams of 85% phosphoric acid, 8.5 grams of 70% nitric acid, 16.5 grams of Triton™ X-100 (available from The Dow Chemical Company) and 11.1 grams of Triton CF-10 (available from The Dow Chemical Company) to five gallons of volume with deionized water, and then neutralizing to pH 3.0 with Chemfil Buffer (available from PPG Industries), and then adding the desired amount of copper as the copper(II)chloride dihydrate. After treatment in the acid solution, the panels were rinsed thoroughly with deionized water and blown dry with a warm air blowoff. The panels were then electrocoated with ED 6100H, a cathodic electrocoat available from PPG Industries. The ED 6100H coating bath was prepared and coated out, and the coated panels cured, according to the manufacturer's instructions.

After coating, panels were subjected to the Honda Salt Water Resistance test for 20 cycles. After testing, the panels were media-blasted to remove loose paint and corrosion products, and paint loss from the scribe (creep) was measured and the average calculated in millimeters for each panel. The results appear in Table I, below:

TABLE I

| Copper in Acid Treatment | Avg creep (mm) |
|---|---|
| Alkaline clean only (no acid treatment) | Total coating loss |
| None | 22.0 mm |
| 1 ppm | 15.0 mm |
| 5 ppm | 12.0 mm |
| 10 ppm | 10.0 mm |

Example 2

CRS panels were cleaned by spraying with a solution of Chemkleen 490MX, an alkaline cleaner available from PPG Industries, for two minutes at 120° F. After alkaline cleaning, the panels were rinsed thoroughly with deionized water. The panels were then immersed in an acidic solution containing either no copper or 50 ppm of copper for two minutes at 120° F. The acid solution was prepared as in example 1, except that copper was added as copper(II)nitrate hemipentahydrate. After treatment in the acid solution, the panels were rinsed thoroughly with deionized water, and then dried with a warm air blowoff. The panels were then electrocoated with ED 6100H, a cathodic electrocoat available from PPG Industries. The ED 6100H coating bath was prepared and coated out, and the coated panels cured, according to the manufacturer's instructions.

After coating, panels were tested for corrosion resistance by subjecting them to the GM 9540 P test for 30 cycles. After testing, the panels were media-blasted to remove loose paint and corrosion products, and paint loss from the scribe (creep) was measured and the average calculated in millimeters for each panel. The results appear in Table II, below:

TABLE II

| Copper in Acid Treatment | Avg creep (mm) |
|---|---|
| None | 9.0 mm |
| 50 ppm | 5.0 mm |

A CRS panel cleaned in the alkaline cleaner, without any subsequent acid treatment, would typically have about 12 mm of scribe creep in this test.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

We claim:

1. A method for passivating a metal substrate surface comprising:

(a) depositing an electropositive metal onto at least a portion of the substrate, wherein the electropositive metal is deposited by contacting the substrate with a plating solution of a soluble metal salt that is essentially free of chromates and trication metal phosphates, wherein the electropositive metal is included in the plating solution in an amount from 1 to 50 ppm of total metal, measured as elemental metal; followed immediately by (b) electrophoretically depositing on the substrate a curable, electrodepositable coating composition.

2. The method of claim 1, wherein step (a) includes rinsing the metal substrate after deposition of the electropositive metal.

3. The method of claim 2, wherein the metal substrate is rinsed with deionized water.

4. The method of claim 2, wherein step (a) includes drying the metal substrate after rinsing.

5. The method of claim 1, wherein the electropositive metal is selected from the group consisting of nickel, copper, silver, gold and mixtures thereof.

6. The method of claim 5, wherein the electropositive metal comprises Copper.

7. The method of claim 1, wherein the substrate is immersed in the plating solution.

8. The method of claim 1, wherein the plating solution further comprises at least one mineral acid.

9. The method of claim 8, wherein the pH of the plating solution is less than 6.

10. The method of claim 1, wherein the substrate is not contacted with any pretreatment composition other than the plating solution.

11. The method of claim 1, wherein the electrodepositable composition comprises a resinous phase dispersed in an aqueous medium wherein the resinous phase comprises:

(i) an active hydrogen group-containing ionic electrodepositable resin, and (ii) a curing agent having functional groups reactive with the active hydrogen groups of (i).

12. The method of claim 11, wherein the ionic electrodepositable resin is cationic.

13. The method of claim 1, wherein step (b) includes heating the substrate after deposition of the curable, electrodepositable coating composition to a temperature of 250 to 400° F. (121.1 to 204.4° C.) for a time sufficient to effect cure of the electrodepositable composition.

14. The method of claim 1, wherein the soluble metal salt comprises a water soluble copper salt.

15. The method of claim 14, wherein the water soluble copper salt is selected from copper cyanide, copper potassium cyanide, copper sulfate, copper nitrate, copper pyrophosphate, copper thiocyanate, disodium copper ethylenediaminetetraacetate tetrahydrate, copper bromide, copper oxide, copper hydroxide, copper chloride, copper fluoride, copper gluconate, copper citrate, copper lauroyl sarcosinate, copper formate, copper acetate, copper propionate, copper butyrate, copper lactate, copper oxalate, copper phytate, copper tartarate, copper malate, copper succinate, copper malonate, copper maleate, copper benzoate, copper salicylate, copper aspartate, copper glutamate, copper fumarate, copper glycerophosphate, sodium copper chlorophyllin, copper fluorosilicate, copper fluoroborate, copper iodate, copper (II) chloride dihydrate, copper (II) nitrate pentihydrate, copper salts of carboxylic acids in the homologous series formic acid to decanoic acid, copper salts of polybasic acids in the series oxalic acid to suberic acid, and copper salts of hydroxycarboxylic acids.

16. The method of claim 14, wherein the water soluble copper salt is included in the plating solution in an amount from 10 to 50 ppm of total copper, measured as elemental copper.

* * * * *